US005845457A

United States Patent [19]

Wybauw

[11] Patent Number: 5,845,457

[45] Date of Patent: Dec. 8, 1998

[54] FLOOR, METHOD FOR MANUFACTURING IT, AND BUILDING INCLUDING AT LEAST ONE SUCH FLOOR

[75] Inventor: Jacques Wybauw, Bruzelles, Belgium

[73] Assignee: Rebuild World RBW S.A., Luxembourg, Luxembourg

[21] Appl. No.: 704,598

[22] PCT Filed: Mar. 17, 1995

[86] PCT No.: PCT/BE95/00024

§ 371 Date: Dec. 6, 1996

§ 102(e) Date: Dec. 6, 1996

[87] PCT Pub. No.: WO95/25861

PCT Pub. Date: Sep. 28, 1995

[30] Foreign Application Priority Data

Mar. 18, 1994 [BE] Belgium ..... 9400296

[51] Int. Cl.[6] ..... E04F 15/20; E04B 1/348; B28B 23/00; B28B 7/00

[52] U.S. Cl. ..... 52/745.2; 52/745.13; 52/742.14; 52/143; 264/278; 249/83; 249/91; 249/93

[58] Field of Search ..... 52/745.2, 745.19, 52/745.13, 742.1, 742.14, 747.12, 250, 251, 258, 263, 236.5, 79.14, 143, 403.1, 408, 414, 630, 781.5; 264/278; 249/83, 91, 93

[56] References Cited

U.S. PATENT DOCUMENTS

| | | | |
|---|---|---|---|
| 2,091,750 | 8/1937 | Coddington | 52/781.5 |
| 3,213,581 | 10/1965 | Macchi | 249/83 X |
| 3,378,971 | 4/1968 | Singer et al. | 52/263 |
| 3,535,841 | 10/1970 | Lorenz et al. | 52/250 X |
| 4,184,296 | 1/1980 | Vitalini . | |
| 4,436,274 | 3/1984 | Kramer | 52/403.1 X |
| 4,583,336 | 4/1986 | Shelangoskie et al. | 52/250 |
| 4,593,880 | 6/1986 | Smith et al. | 249/91 |
| 4,639,204 | 1/1987 | Munsey et al. . | |
| 4,660,344 | 4/1987 | Gaudelli et al. . | |
| 4,804,160 | 2/1989 | Harbeke | 249/91 X |
| 4,823,527 | 4/1989 | Harbeke | 249/91 X |
| 4,873,799 | 10/1989 | Flink | 52/408 X |
| 4,882,886 | 11/1989 | Harbeke | 249/91 X |
| 5,560,150 | 10/1996 | Pearson | 52/143 X |

FOREIGN PATENT DOCUMENTS

| | | | |
|---|---|---|---|
| 804035 | 6/1951 | Germany . | |
| 2930895 | 2/1981 | Germany . | |
| 3510473 | 10/1986 | Germany . | |
| 3510756 | 10/1986 | Germany . | |
| 8800710 | 4/1988 | Germany . | |
| 495534 | 2/1956 | Italy | 52/781.5 |

*Primary Examiner*—Robert Canfield
*Attorney, Agent, or Firm*—White & Case

[57] ABSTRACT

A floor for buildings is disclosed. The floor comprises a prefabricated reinforced concrete slab (1) with a smooth flat top surface (15), said slab (1) having been cast upside-down in a mould with a smooth flat bottom (2). Said slab (1) is supported on a base (11) arranged beneath the slab (1) with the weight of the slab (1) uniformly distributed thereover. A method for making said floor is also disclosed.

10 Claims, 3 Drawing Sheets

FLOOR, METHOD FOR MANUFACTURING IT, AND BUILDING INCLUDING AT LEAST ONE SUCH FLOOR

CROSS REFERENCE TO RELATED APPLICATION

This application is a national stage application filed under 35 U.S.C. § 371 of international Application No. PCT/BE95/00024.

1. Field of the Invention

The invention relates to a floor as well as to a method for the manufacture of this floor.

2. Technological Background and State of the Art

In the field of building, the floor is a construction which constitutes a horizontal platform at the lower level of the construction work, or a separation between two storeys.

Numerous techniques have been put forward and implemented and various materials have been used to produce floors.

Featuring among the oldest known floors is, in particular, the rustic floor formed of planks nailed to joists.

In many cases, it is preferable to produce floors from non-combustible materials. Particularly well known are floors consisting of reinforced concrete slabs poured in situ and secured to the walls or framework of the building. Also well known are floors formed of beams or girders (made of concrete or of metal) between which concrete blocks are placed by way of filling. Such floors composed of blocks just like those which consist of concrete slabs poured in situ do, however, have rather to be considered as constituting the fabric of floors. It is then commonplace for such floors to be covered with a screed which is generally made with a hydraulic setting material essentially consisting of a wet mix of cement and sand.

The production of such a floor screed leads to all the known drawbacks inherent with wet sites. The placing of hydraulic-setting materials is a messy operation during which the other bodies of craftsmen have to keep away. Furthermore, the setting and curing of the hydraulical-setting material takes a great deal of time (a few weeks), which complicates and delays the time schedule for the work.

In any case, the production of such a floor screed requires qualified labour and, despite that, the surface of the screed is never free of defects and its mechanical strength as well as its hydrophobia are not optimal. In general, such a screed is further covered with a finishing covering such as tiling, plain carpet, linoleum, etc.

According to some known techniques, a layer of thermal insulant is interposed between the fabric of the floor and the floor screed.

It is also known for heating elements to be embedded within the floor screed, these sometimes being electric resistors but more commonly being serpentine coils which are connected to a feed circuit and through which a heat-transfer fluid can be made to circulate. When heating elements are embedded within the screed, it is obviously quite particularly advantageous for a thermal insulant to be interposed between this screed and the fabric of the floor.

It is also well known for an anti-vibration mat to be interposed between the fabric of the floor and the screed of this floor, thus providing acoustic insulation between the storeys and reducing, in particular, the transmission of footsteps to the storey below. Such screeds which are commonly known as "floating screeds" or "floating slabs" may possibly be equipped with heating elements embedded within them.

Patent Application DE-A-29 30 895 describes a floor including a screed which rests on its support via a thermally insulating layer and an acoustically insulating layer. The screed itself is poured in situ "by a wet route" and heating pipes are embedded within it.

All of these known techniques for producing floors which involve the pouring of screeds on site, inevitably lead to the drawbacks mentioned early.

A method for producing floating screed is known according to which successive layers of plaster board are placed on a mat of anti-vibration material. When these plaster boards are laid, care is taken to stagger the joints between the boards of one layer relative to the joints between the boards of the neighbouring layers. Such a floating screed is therefore produced dry and quite cleanly but its mechanical strength and its resistance to water are insufficient for certain applications. In any case, such a floating screed has necessarily to be covered with a finishing covering.

The anti-vibration mats used to produce floating screeds are quite fragile and therefore vulnerable. It has been possible to observe that with the techniques currently employed, these mats are easily damaged by the workers producing the screed. There is therefore an excessively high risk of the creation of "phonic bridges" which practically cancel out the acoustic insulation properties of the floating screed.

In conclusion, it is observed that the techniques for producing floors currently employed have all the fairly major drawbacks regarding the problems and constraints which they entail and/or regarding the characteristics of the floors produced. These problems and constraints to which these techniques lead are felt, in particular (but not exclusively) when use is made of rapid methods of construction of buildings making use of prefabricated elements assembled together on site. Using such construction methods it is highly advantageous to be able to produce the building as a "dry site". The in-situ pouring of floors or floor screeds is therefore highly ill-suited to these methods. In addition, one of the very substantial advantages of the construction of buildings by assembling together prefabricated elements consists in the speed of execution; a substantial part of this advantage is lost if the floors or floor screeds are poured in situ (and have then to set, cure and dry over a number of weeks).

OBJECTS OF THE INVENTION

Efforts have therefore been made to employ a method making it possible rapidly to produce floors having good physical properties.

Another object of the invention is to employ such a method which makes it possible, if so desired, to produce a floor which gives good acoustic insulation between storeys.

Another object of the invention is to employ such a method which makes it possible, if so desired, to produce a floor with built-in heat exchangers.

Another object of the invention is to provide such floors having a very satisfactory surface finish making it possible, if so desired, for them not to be covered with an additional covering.

ESSENTIAL ELEMENTS OF THE INVENTION

The subject of the present invention is a method for producing a floor for a building, this method including the following operations:

a) providing a mould for a reinforced concrete slab, this mould including a mould bottom with a flat and smooth surface and a frame against which the edges of the slab will be formed, this frame being fixed detachably to the mould bottom, b) placing this mould in a horizontal plane, the flat and smooth surface of the mould bottom facing upwards, c) placing a concrete reinforcement in this mould, d) putting in place in this mould dismantlable securing means capable of securing the bottom of the mould and the concrete slab together after the latter has been moulded, e) pouring concrete into the mould and leaving the slab thus formed to cure, f) producing a support on which the concrete slab will be placed and on which the weight of this slab will be distributed substantially uniformly, and putting this support in place in the building, g) transporting the concrete slab contained in its mould to the said support, h) removing the frame from the mould, i) turning the assembly formed by the mould bottom and the concrete slab upside down and placing this assembly on the said support, j) detaching the concrete slab from the mould bottom and removing this mould bottom.

As mentioned above, it is this entire method which forms the subject of the invention. It will be noted that among the various operations of the method of the invention, those indicated respectively by the letters d, f, g, i and j are particularly original.

The concrete slab used in the method according to the invention will advantageously be produced in the factory, in a plant for casting concrete constructional elements.

As regards the production and placement of the said support, several alternative forms of the method according to the invention may be applied.

According to a first one of these alternative forms, the said support is put in place in the building under construction separately and the concrete slab (made at the factory) is transported (contained in its mould) to the site on which the building is being constructed, where it is then put in place on its support.

According to another alternative form of the method, the said support and the concrete slab are both made at the factory, and it is also at the factory that the said slab is placed on its support, the assembly consisting of the slab and the support on which it rests then being transported to the construction site where this assembly is put in place in the building. This second alternative form of the method may be particularly advantageous in the case where the support itself is a prefabricated construction element or forms part of a prefabricated construction unit.

According to a preferred embodiment of the invention, the mould bottom is equipped with stiffening means mounted against its face which is opposite its said flat and smooth surface (that is to say, against its face which, during the casting operation, faces downwards). This stiffening is generally necessary because the slabs to be cast which have a small thickness and large surface-area have to be able to be transported and handled, fixed to the mould bottom.

The mould bottom is advantageously provided with attachment means capable of making it easier for it to be handled by cranes or other lifting means.

According to a preferred embodiment of the invention, an anti-vibration mat is interposed between the concrete slab and its support. A floating-slab floor is thus obtained.

The floor slabs produced according to the invention are slabs which are thin but generally have a large surface-area.

In most cases, the floor of a room of the building may be produced with a single prefabricated slab according to the invention. For large sized rooms in the building, it may be necessary or advantageous to produce the floor by the juxtaposition of two or more slabs according to the invention. This is because it is important that the size of these slabs should not prevent their handling and their transportation.

The upper surface of the slabs put in place is, in any case, perfectly flat and smooth which means that for many applications it is unnecessary to cover them with a covering.

The appearance of the upper face of the floor slab may be further improved by employing a specific embodiment of the invention, according to which, before the concrete is poured into the mould, a layer of mortar supplemented with filler materials or with pigments capable of giving the upper face of the slab a decorative appearance is first of all poured into this mould.

When casting the concrete slab it is advantageous to vibrate the concrete as is commonly done.

According to a particular embodiment of the method according to the invention, a serpentine coil capable of conveying a heat-transfer fluid is arranged in the mould prior to the pouring of the concrete. This serpentine coil is arranged such that its ends exit via a lateral edge of the slab.

According to an advantageous embodiment of the method according to the invention, the mould is of a shape such that a rebate is formed along the edge of the face of the concrete slab which is in contact with the bottom of the mould.

Another subject of the invention is a floor for a building including a continuous, coherent and cured layer of hydraulic setting material and a support situated beneath the said layer and over which the weight of this layer is distributed substantially uniformly. In the floor according to the invention, the said layer consists of a prefabricated slab of reinforced concrete, the upper face of which has a flat and smooth surface, this slab having been cast upside down in a mould the bottom of which has a flat and smooth surface.

According to a preferred embodiment of the invention, the floor includes an intermediate layer between the said support and the concrete slab.

This intermediate layer may possibly be thin (a few millimeters) and consist, for example, of a rot-proof felt capable of compensating for small unevennesses exhibited by the upper face of the support and the lower face of the slab, so as to distribute the weight of the slab as uniformly as possible over the support.

The intermediate layer will advantageously consist of an anti-vibration mat so that the concrete slab is a floating slab thus giving good acoustic insulation between storeys and, in particular, damping out the transmission of footsteps towards the storey below.

The intermediate layer may just as easily be made of a thermal insulation material.

When an anti-vibration mat is interposed between the support and the concrete slab, this anti-vibration mat already provides quite good thermal insulation but it may be desirable to interpose a layer made of a material providing good thermal insulation between the anti-vibration mat and the concrete slab.

The thermal insulation of the concrete slab relative to its support is obviously particularly important when heating elements (or, more generally, heat exchangers) are embedded within the concrete slab.

The concrete slabs used for producing the floors according to the invention are, as a general rule, thin and of a large surface-area.

According to an advantageous embodiment, the concrete slabs used have a surface-area of at least 3 $m^2$ and preferably at least 6 $m^2$. The thickness of these slabs is advantageously between 3 and 7 cm, and, for preference, between 4 and 6 cm.

In order to produce the floors according to the invention, use may be made of very diverse supports.

The support for the prefabricated concrete slab according to the invention may especially consist of a continuous slab of concrete poured in situ (but the upper surface of which is therefore not perfectly flat and smooth).

The support for the concrete slab according to the invention may just as easily consist of a series of beams or girders (made of metal or of concrete). Since it is desirable for the concrete slabs to be thin, the separation between the supporting beams or girders has therefore to take this into account. In most cases, this separation will be less than 40 cm.

According to a specific embodiment of the invention, the support consists of a profiled sheet such as a trapezoidal sheet.

The concrete slab of the floor according to the invention may include, embedded within it, at least one serpentine coil capable of conveying a heat-transfer fluid and connection means for connecting this serpentine coil to a feed circuit.

According to a specific embodiment, the concrete slab has a shape which is basically rectangular with chopped corners. When such a slab is provided with a serpentine coil, the means for connecting this serpentine coil are advantageously situated in the chopped-off corners of the slab.

According to a specific embodiment, the concrete slab includes a rebate along the edges of its upper face, this rebate being capable of interacting with a joint laid between two neighbouring slabs.

When two neighbouring slabs are provided with such a rebate, a profiled joint with a T-shaped cross-section is preferably inserted between them, the dimensions of each rebate corresponding to those of one of the branches of the T-section.

The subject of the invention is also a building which includes at least one floor in accordance with the invention or produced according to the method in accordance with the invention.

One of the important advantages of the technique according to the invention consists in the fact that it allows the very rapid and dry production of floors having good properties. The concrete slabs may be cast at the factory, away from the work site, several weeks before the slabs have to be put in place in the building under construction.

This method of producing floors may be used for buildings of very diverse types.

The economical advantage of the method is of particular importance when quite a large number of slabs have to be produced for a site or for a series of sites.

It will be understood that it is advantageous to be able, as far as possible, to produce slabs in a small number of formats.

It is especially for this reason that the advantages of the method according to the invention are particularly substantial when this method is applied to the production of floors in modular buildings and especially in buildings produced by assembling together prefabricated construction units of standardized dimensions.

BRIEF DESCRIPTION OF THE DRAWINGS

Other specific features and advantages of the invention will emerge from the description below of one particular embodiment of the invention, this being applied here more specifically to buildings produced by the assembling together of modular construction units, reference being made to the attached drawings, in which.

DETAILED DESCRIPTION OF THE DRAWINGS

The floating slab according to the invention, by contrast with a conventional "floating screed" is not produced in situ but in a mould, to the desired dimensions.

Figure 1:
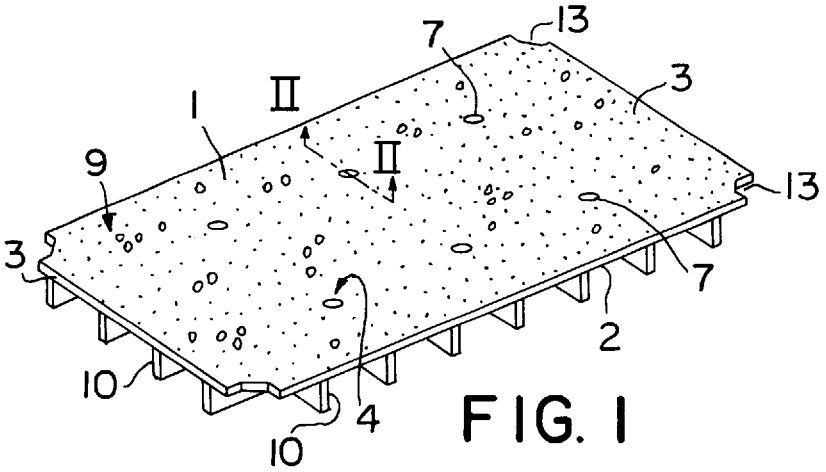
FIG. 1 is a perspective view of a slab according to the invention, during the manufacturing stage.
Figure 7:
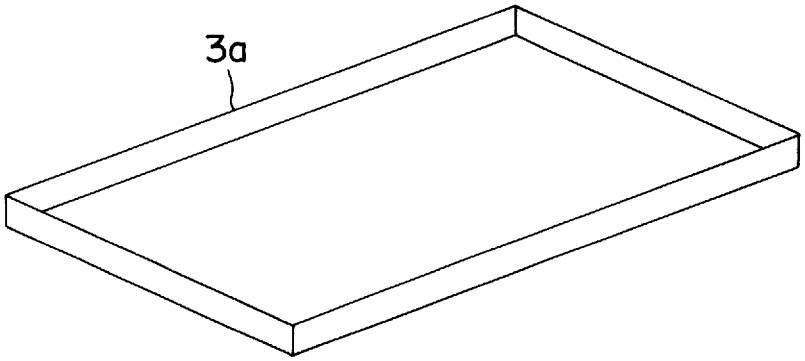
FIG. 7 is a prespective view of a frame which surrounds the edges of the slab shown in FIG. 1.

The slab 1, made of reinforced concrete, is represented in FIG. 1 resting on the bottom 2 of the mould in which it was made. The other parts of the mold, which are intended to form edges 3 of the slab 1, do not have any specific features, but may comprise a frame 3*a*, which is shown in FIG. 7 The edges 3 of slab 1 are formed against the frame 3*a*, which is fixed detachbly to bottom 2 of the mold.

Figure 2:
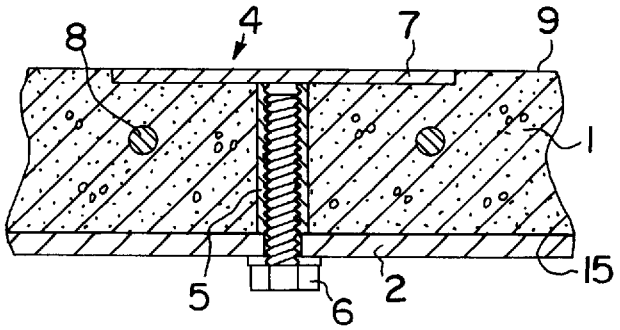
FIG. 2 is a view in section on a vertical plane II—II of a detail of the slab of FIG. 1.

The slab 1 is secured to the mould bottom 2 by dismantlable fixtures 4 which can be seen in greater detail in FIG. 2.

By virtue of these fixtures 4, it is possible to manipulate and turn over the slab 1 with its mould bottom 2 quite simply without the risk of breaking or cracking this thin slab (thickness 5 cm).

FIG. 2 shows on a larger scale the slab 1 in section at the point of one of these dismantlable fixtures 4.

The fixture 4 represented essentially includes a tubular element 5 intended to be embedded within the slab 1. This tubular element 5 is internally threaded and interacts with a bolt 6 which holds it in place relative to the mould bottom 2. Fixed to the end of this tubular element 5 is a flange 7 intended to distribute the stresses exerted on the fixture 4 through the slab 1 after the concrete of which it is composed has set. FIG. 2 represents, in section, elements of a light-weight reinforcement 8 embedded within the slab 1.

The flange 7 is represented in FIGS. 1 and 2 lying flush with the surface 9 of the slab; this does not in any way detract from the appearance of the slab 1, as this surface 9 is intended to form the lower face of the slab 1 once the latter has been turned over and put in place.

In order to detach the slab 1 from the bottom of the mould 2 after the cured slab 1 has been put in place, all that is required is to unscrew the bolt 6, the head of which is accessible. It will be obvious to those skilled in the art that it is possible to use a number of alternative forms of this fixture 4 for the same function without departing from the scope of the invention.

The mould bottom 2 also includes stiffeners 10. The presence of these stiffeners 10 may be explained by the small thickness of the slab 1 and by its large dimensions, which correspond substantially to those of the lower horizontal element 11 of a prefabricated construction unit 12, as made be seen in FIG. 3. The lower horizontal element 11, which is described in greater detail below, acts as a support for the slab 1. The corners 13 of the slab 1 are chopped off so as to match the specific shape of this modular construction unit 12, which consists essentially of a lower horizontal element 11 in the form of a box and of posts 14 with a V-shaped section which can be erected at each corner of this lower element 11.

The V-shaped form of these posts 14 allows the electrical circuits and pipework serving the storeys below or above of the building (not represented) in which the construction unit 12 is intended to be incorporated to be routed down their channel.

The chopped-off corners 13 of the slab 1 give easy access allowing the routing of these circuits and pipework, as explained later.

That face of the mould bottom 2 which faces the slab 1 has a good surface finish, and this straight away gives the corresponding face 15 of the slab 1 a smooth and cared-for appearance. It is this actual face 15 with caredfor appearance which is used as the upper face of the floating slab 1, after turning upside down and mould release.

As there is therefore no limitation imposed by the characteristics of a mixture which lends itself to smoothing (fluidity, setting time, etc), it is possible, in order to produce the slab 1 according to the invention, to use any type of concrete making it possible to obtain a reinforced concrete slab 1 which has the desired mechanical or physical properties (hydrophobia etc).

The slab 1 according to the invention, intended to be put in place as a floating slab, can be manufactured at the factory. Thanks to this factory prefabrication, the organization and programme of construction of a building are therefore not impeded or slowed down by the setting and drying-out time of the floating slab.

It will be understood that in these conditions, it is possible to lay an anti-vibration mat 16 with greater care and with less danger of damaging it than on a conventional work site.

It is even possible to effect a quality control directly after laying, with almost instantaneous location of any (improbable) defect and to remedy such a defect immediately.

Figure 3:
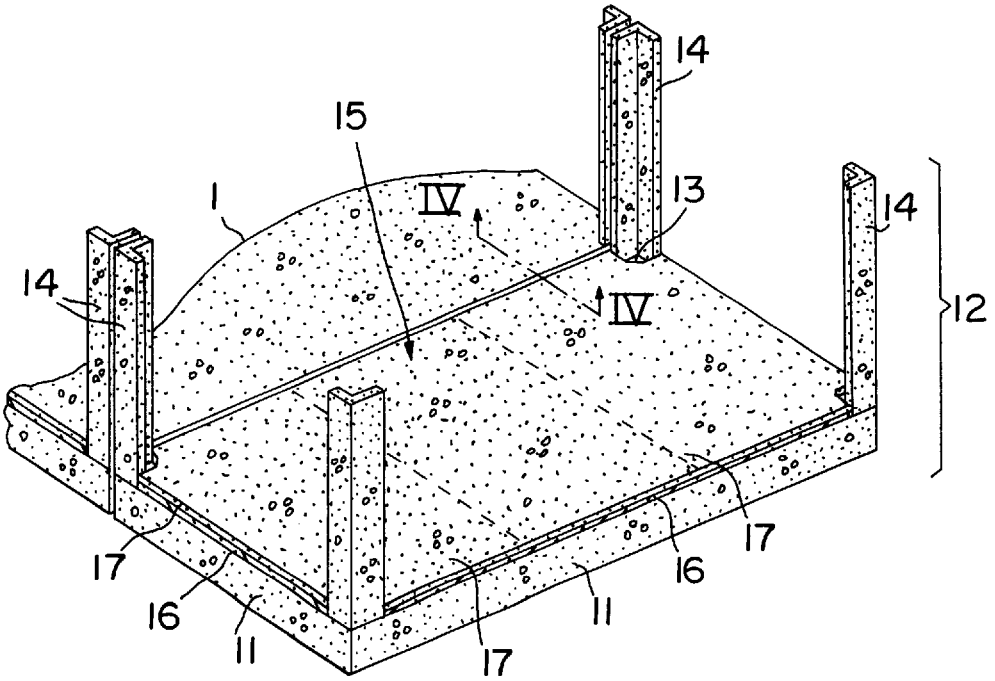
FIG. 3 is a perspective view of a slab after it has been put in place on the lower horizontal element of a modular construction unit.

The slab 1 represented in FIG. 3 was poured with standard dimensions corresponding to those of the lower horizontal element 11 of a construction unit 12, which may represent twenty square meters or so. For reasons of ease of handling, it may be possible to produce such a floating slab 1 from several smaller and therefore more handlable parts 17 (of +6 $m^2$ for example).

These parts 17 (bounded by broken lines in FIG. 3) are assembled together by conventional methods for the assembly of sheets of reinforced concrete, once put in place on the lower horizontal element 11 of the modular construction unit 12.

Figure 4:
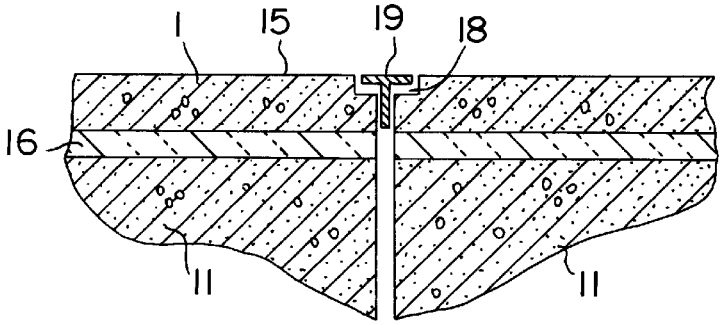
FIG. 4 is a view in section on the vertical plane IV—IV of FIG. 3.

FIG. 4 shows, in greater detail, a connection between two floating slabs 1 according to the invention, each one laid on the lower horizontal element 11 of juxtaposed construction units 12, as represented in FIG. 3.

As these floating slabs 1 have a smooth and beautifully finished appearance, they make the presence of an additional decorative covering superfluous. The absence of such a covering does, however, make it necessary for the joints between two neighbouring slabs 1 to have a particularly clean appearance.

To this end, a rebate 18 is formed during casting along the perimeter of the upper face 15 of each floating slab 1.

A joint 19 which is in the form of a T-shaped extruded section is inserted at the joint between two floating slabs 1.

The thickness of the bar of the T corresponds to the depth of the rebates 18 so that the top of the joint 19 comes just level with the upper surface of the two floating slabs 1, avoiding any visible discontinuity.

The joint 19 is preferably made of an elastic material with a low thermal conductivity (such as a plastic) so as to avoid the creation of an acoustic bridge between two neighbouring slabs 1.

The laying of such a joint 19 implies that the rebates 18 have to have very tightly controlled dimensions, something which cannot be obtained with a conventional floating screed, but is easily achieved by virtue of the method of casting adopted for this slab 1.

Figure 5:
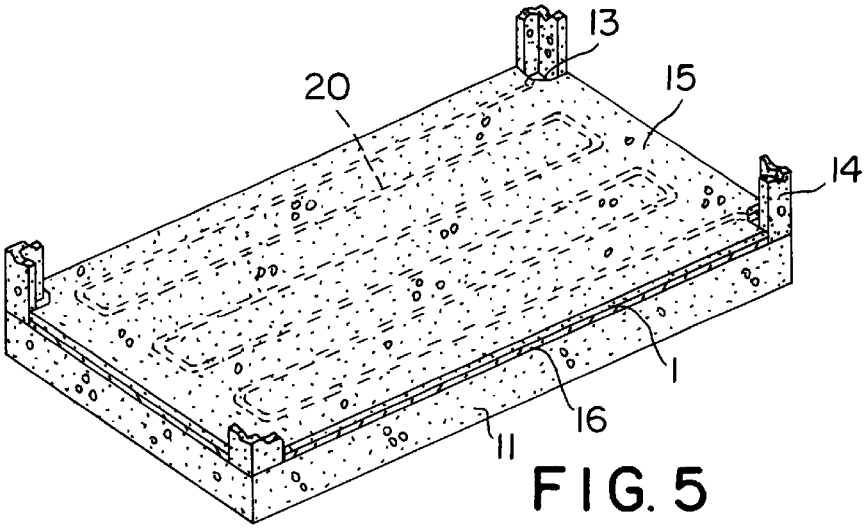
FIG. 5 is a perspective view of a slab including heating elements embedded within it.

FIG. 5 shows an advantageous embodiment of a floating slab 1 according to the invention, which comprises heating elements 20 embedded within the slab 1.

Floor heating is known to cause few problems provided it has been laid properly. In the case of this floating slab 1, the heating engineers can work under optimum conditions, because they can get on with laying the heating elements 20 in a specially fitted-out factory, namely away from all the constraints of time scales and of inclement weather imposed by work on site.

If required, it may even be possible to envisage the laying of several heating elements 20 with different powers, the only technical restriction being that of being able to connect the heating elements 20 after the slab 1 has been put in place.

When laying the heating elements 20 it is advantageous for the connecting means (connections, etc) for these heating elements 20 to be arranged in the chopped-off corners 13 of the floating slab 1, so that they can easily be connected to the circuits laid in the channels of the posts 14.

Figure 6:
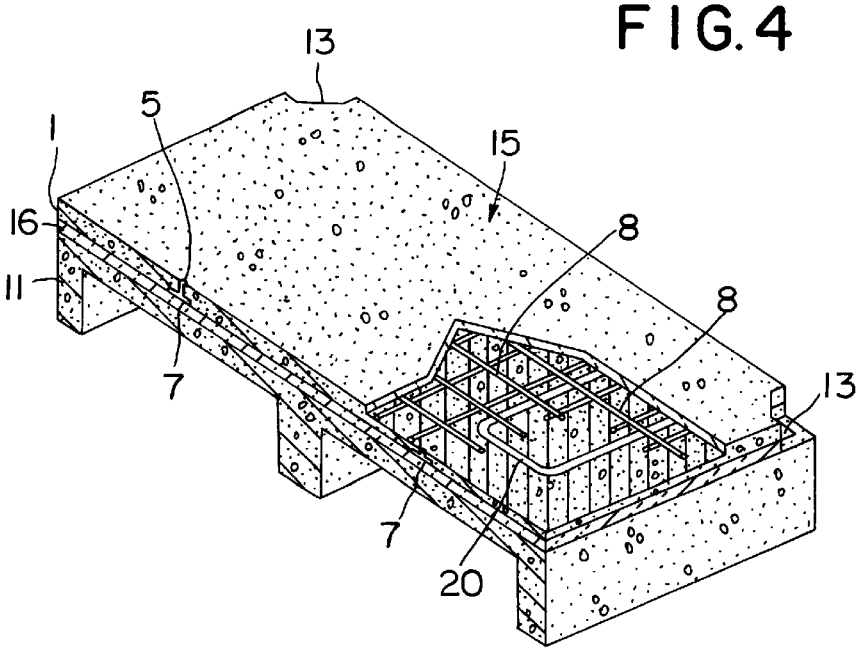
FIG. 6 is a perspective view, with cutaway, of a slab with heating elements, placed on the lower horizontal element of a modular construction unit.

FIG. 6 shows, in perspective, a section with cut-away of a floating slab 1 put in place on the lower horizontal element 11 of a construction unit 12.

In particular, it is possible to see in this section the remaining parts 5, 7 of the fixtures 4 which were used, before it was put in place, to hold the slab 1 on the mould bottom 2.

Now that the mould bottom 2 has been removed, small orifices remain on the upper face of the slab 1, and these, once plugged, become almost invisible.

The cut-away makes it possible also to see the reinforcing elements 8 embedded in the slab 1.

The upper face 15 of the slab 1 has all the qualities of a finished covering (hardness, resistance to water and to moisture). In order to improve its aesthetic qualities it is possible, when casting, to spread and distribute over the mould bottom 2 a layer of a mixture of mortar supplemented with a filler (dyes, decorative granules, etc) giving the surface 15 of the demoulded slab 1 a decorative appearance, of the granite-like type for example, which makes additional covering superfluous.

I claim:

1. Method for producing a floor for a building, including the following operations:

a) providing a mould for a reinforced concrete slab, this mould including a mould bottom with a flat and smooth surface and a frame against which the edges of the slab will be formed, this frame being fixed detachably to the mould bottom, b) placing this mould in a horizontal plane, the flat and smooth surface of the mould bottom facing upwards, c) placing a concrete reinforcement in this mould, d) putting in place in this mould dismantlable securing means capable of securing the bottom of the mould and the concrete slab together after the latter has been moulded, e) pouring concrete into the mould and leaving the slab thus formed to cure, f) producing a support on which the concrete slab will be placed and on which the weight of this slab will be distributed substantially uniformly, g) transporting the concrete slab contained in its mould to the said support, h) removing the frame from the mould, i) turning the assembly formed by the mould bottom and the concrete slab upside down and placing this assembly on the said support, j) detaching the concrete slab from the mould bottom and removing this mould bottom.

2. Method according to claim 1, wherein the support is put in place in the building under construction separately and the concrete slab made at the factory, is transported, contained in its mould, to the site on which the building is being constructed, where the slab is then put in place on the support.

3. Method according to claim 1, wherein the support and the concrete slab are both made at the factory, and it is also at the factory that the slab is placed on its support, the assembly consisting of the slab and the support on which it rests then being transported to the construction site where this assembly is put in place in the building.

4. Method according to claim 1, wherein the mould bottom is equipped with stiffening means mounted against its face which is opposite its said flat and smooth surface.

5. Method according to claim 1, wherein the mould bottom is provided with attachment means capable of making it easier for it to be handled by cranes or other lifting means.

6. Method according to claim 1, further including the following operation, prior to putting the concrete slab in place on its support.

placing an anti-vibration mat on the upper face of the said support.

7. Method according to claim 1, further including before pouring the concrete into the mould, the following operation:

pouring into the bottom of the mould a layer of mortar supplemented with filler materials capable of giving the upper face of the slab a decorative appearance.

8. Method according to claim 1, wherein the concrete of the slab is vibrated.

9. Method according to claim 1, further including the following operation:

placing in the mould, prior to the pouring of the concrete, at least one serpentine coil capable of conveying a heat-transfer fluid, the ends of this serpentine coil exiting via a lateral edge of the slab.

10. Method according to claim 1, wherein the said mould is of a shape such that a rebate is formed along the edges of the face of the concrete slab in contact with the bottom of the mould.

* * * * *